US011735350B2

(12) United States Patent
Sheng

(10) Patent No.: US 11,735,350 B2
(45) Date of Patent: Aug. 22, 2023

(54) INDUCTOR

(71) Applicant: Murata Manufacturing Co., Ltd., Kyoto-fu (JP)

(72) Inventor: Jianxin Sheng, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 413 days.

(21) Appl. No.: 17/082,820

(22) Filed: Oct. 28, 2020

(65) Prior Publication Data

US 2021/0134514 A1 May 6, 2021

(30) Foreign Application Priority Data

Nov. 1, 2019 (JP) ..... 2019-200132

(51) Int. Cl.
*H01F 27/255* (2006.01)
*H01F 27/28* (2006.01)
(Continued)

(52) U.S. Cl.
CPC ..... *H01F 27/255* (2013.01); *H01F 27/2804* (2013.01); *H01F 27/29* (2013.01); *H01F 41/0246* (2013.01); *H01F 41/041* (2013.01)

(58) Field of Classification Search
CPC .... H01F 27/255; H01F 27/2804; H01F 27/29; H01F 41/0246; H01F 41/041; H01F 2017/0073; H01F 2017/048; H01F 17/0006; H01F 17/04; H01F 41/046; H01F 27/28; H01F 27/292; H01F 27/34
See application file for complete search history.

(56) References Cited

U.S. PATENT DOCUMENTS 6,026,311 A * 2/2000 Willemsen Cortes ..... H03H 7/0115 336/200
6,424,846 B1 * 7/2002 Cortes ..... H03H 2/00 336/200
(Continued)

FOREIGN PATENT DOCUMENTS

JP H6-267745 A 9/1994
JP H11-251143 A 9/1999
(Continued)

*Primary Examiner* — Marlon T Fletcher
*Assistant Examiner* — Matthew T Sarles
(74) *Attorney, Agent, or Firm* — Studebaker & Brackett PC

(57) ABSTRACT

An inductor includes a body including a coil and a magnetic portion, and having two facing principal surfaces and side surfaces adjacent to the two principal surfaces. The coil includes a winding portion formed from a conductor and a pair of extended portions extended from the winding portion. The magnetic portion includes magnetic powder and contains the coil. The winding portion includes a first meandering portion and a second meandering portion each including straight portions continuously formed so as to extend substantially circularly from an outer side to an inner side of the body when the winding portion is seen through the principal surfaces of the body from the principal surfaces. The first and second meandering portions are continuously formed on the inner side of the body. The straight portions constituting the first meandering portion and the straight portions constituting the second meandering portion are disposed apart from each other.

18 Claims, 8 Drawing Sheets

(51) Int. Cl.

| | |
|---|---|
| ***H01F 41/04*** | (2006.01) |
| ***H01F 41/02*** | (2006.01) |
| ***H01F 27/29*** | (2006.01) |

(56) References Cited

U.S. PATENT DOCUMENTS

| | | | | |
|---|---|---|---|---|
| 2003/0087765 | A1* | 5/2003 | Cortes | H01P 7/082 333/204 |
| 2015/0042440 | A1* | 2/2015 | Tsurumi | H01F 17/0006 336/221 |
| 2019/0074127 | A1* | 3/2019 | Ito | H05K 3/24 |

FOREIGN PATENT DOCUMENTS

| | | | | | |
|---|---|---|---|---|---|
| JP | 2000-114043 | A | | 4/2000 | |
| JP | 2001-244119 | A | | 9/2001 | |
| JP | 2002-043131 | A | | 2/2002 | |
| JP | 2004-048090 | A | | 2/2004 | |
| JP | 2004048090 | A | * | 2/2004 | H01F 17/0013 |
| JP | 2007-067214 | A | | 3/2007 | |
| JP | 2008-294085 | A | | 12/2008 | |
| JP | 2008294085 | A | * | 12/2008 | |
| JP | 2009-009985 | A | | 1/2009 | |
| JP | 2014-013815 | A | | 1/2014 | |
| JP | 2016-146423 | A | | 8/2016 | |
| JP | 2017-069460 | A | | 4/2017 | |
| JP | 2019-134147 | A | | 8/2019 | |
| KR | 10-2015-0079133 | A | | 7/2015 | |
| WO | 2009/075110 | A1 | | 6/2009 | |
| WO | 2018/045007 | A1 | | 3/2018 | |

* cited by examiner

INDUCTOR

CROSS-REFERENCE TO RELATED APPLICATION

This application claims benefit of priority to Japanese Patent Application No. 2019-200132, filed Nov. 1, 2019, the entire content of which is incorporated herein by reference.

BACKGROUND

Technical Field

The present disclosure relates to an inductor.

Background Art

Hitherto, inductors have had various structures in accordance with the purpose of use. As one inductor among such inductors, there exists an inductor including a coil formed by causing a conductor to meander in one plane (refer to, for example, Japanese Unexamined Patent Application Publication No. 2019-134147 and International Publication No. 2018/045007).

In recent years, it has been possible to realize higher frequency and higher current for DC-DC converters. As a result, existing inductors are required to be inductors having a low direct-current resistance and having an inductance value that is small, for example, an inductance value of 30 nH or higher and 100 nH or lower (i.e., from 30 nH to 100 nH). In inductors such as those described in Japanese Unexamined Patent Application Publication No. 2019-134147 and International Publication No. 2018/045007, since conductors are disposed in the same plane, portions where the conductors intersect each other do not exist, as a result of which such inductors are more reliable than inductors having a three-dimensional structure.

However, in inductors such as those described in Japanese Unexamined Patent Application Publication No. 2019-134147 and International Publication No. 2018/045007, an inductance value, a direct-current resistance, and a rated current that is determined by a reduction in the inductance value depend upon the dimensions and structures of the conductors. Therefore, in inductors that are being downsized, it is difficult to reduce the direct-current resistance and increase the rated current that is determined by a reduction in the inductance value, while ensuring a target inductance value.

SUMMARY

Accordingly, the present disclosure provides an inductor that is capable of increasing a range of inductance values that can be dealt with, and that is capable of increasing a rated current that is determined by a reduction in the inductance values and that is capable suppressing an increase in direct-current resistance.

According to preferred embodiments of the present disclosure, an inductor includes a body that includes a coil and a magnetic portion, and that has two principal surfaces that face each other and side surfaces that are adjacent to the two principal surfaces. The coil includes a winding portion formed from a conductor and a pair of extended portions extended from the winding portion. The magnetic portion includes magnetic powder and contains the coil therein. In the inductor, the winding portion includes a first meandering portion and a second meandering portion that each include a plurality of straight portions that are continuously formed so as to extend substantially circularly from an outer side to an inner side of the body when the winding portion is seen through the principal surfaces of the body from the principal surfaces of the body. In addition, the first meandering portion and the second meandering portion are continuously formed on the inner side of the body. Further, the straight portions constituting the first meandering portion and the straight portions constituting the second meandering portion are disposed apart from each other.

According to preferred embodiments of the present disclosure, it is possible to increase a range of inductance values that can be dealt with, and to increase a rated current that is determined by a reduction in the inductance values and to suppress an increase in direct-current resistance.

Other features, elements, characteristics and advantages of the present disclosure will become more apparent from the following detailed description of preferred embodiments of the present disclosure with reference to the attached drawings.

DETAILED DESCRIPTION

Embodiments of the present disclosure are described in detail below based on the drawings. Note that, in the description below, if necessary, terms indicating particular directions and positions (for example, "up", "down", "right", and "left", and different terms encompassing these terms) are used. These terms are used to make it easier to understand the disclosure with reference to the drawings, and the meanings of these terms do not limit the technical scope of the present disclosure. Portions appearing in a plurality of drawings and having the same reference signs are corresponding portions or members.

In the embodiments and examples described below, matters that are the same as previously described matters are not described and only differences are described. In particular, the same operational effects provided by similar structures are not successively mentioned for the embodiments and the examples.

1. First Embodiment

An inductor 1 according to a first embodiment of the present disclosure is described with reference to FIGS. 1 and 2.

Figure 1:
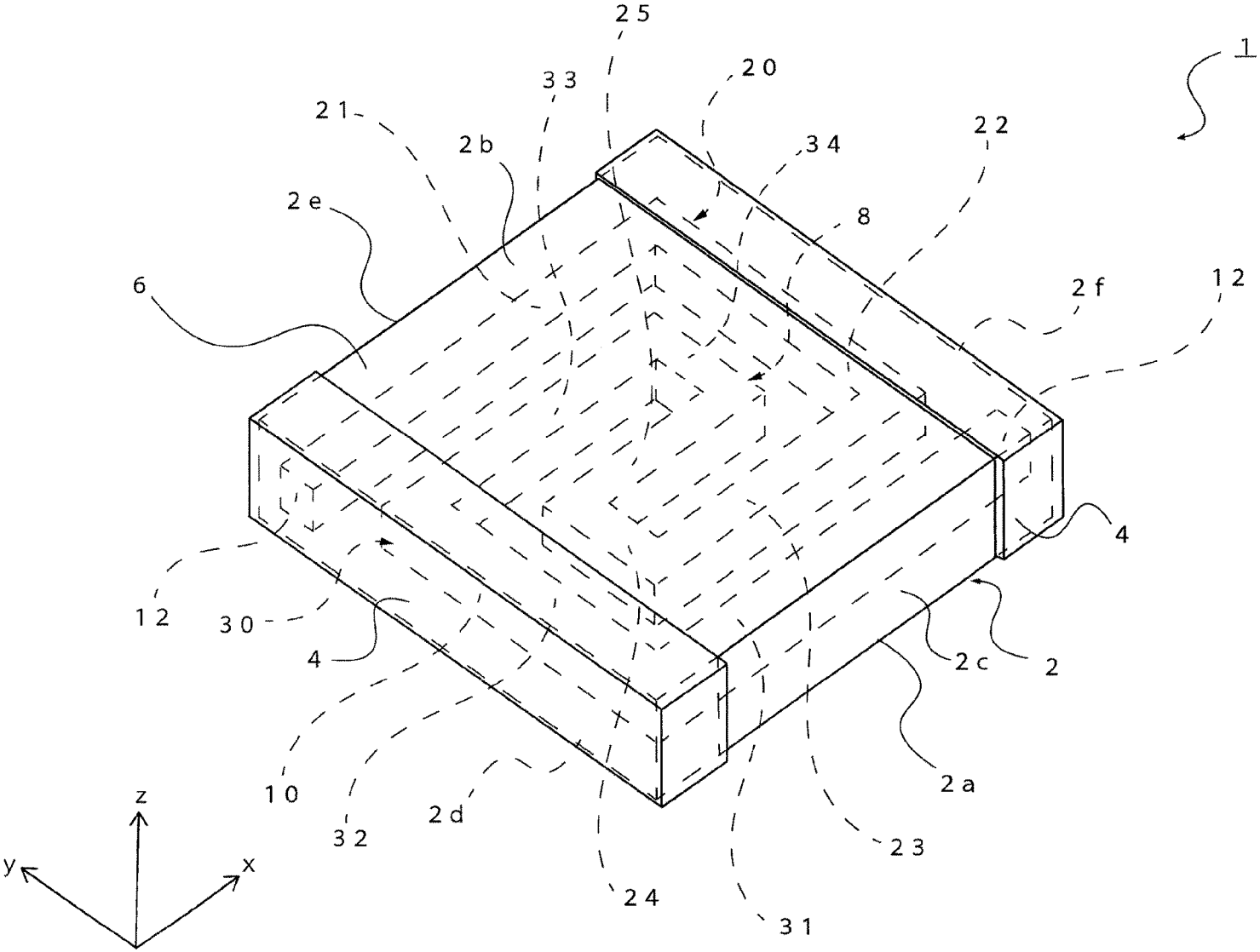
FIG. 1 is a perspective view showing an inductor according a first embodiment of the present disclosure.

FIG. 1 is a perspective view showing the inductor 1 according the first embodiment of the present disclosure. FIG. 2 is a top view of a body shown in FIG. 1.

The inductor 1 according to the first embodiment includes a body 2 and a pair of external electrodes 4 that are formed at a surface of the body 2. The body 2 includes a coil 8 and a magnetic portion 6.

The coil 8 includes a winding portion 10 that is formed by using conductors and a pair of extended portions 12 extended from the winding portion 10.

The magnetic portion 6 is made of a material including magnetic powder and the coil 8 is buried in the magnetic portion 6. However, a section of each extended portion 12 is exposed from the body 2 and is electrically connected to a corresponding one of the external electrodes 4 formed on the body 2.

Body

The body 2 is a substantially rectangular parallelepiped body whose external shape has a first direction (a width direction) x, a second direction (a depth direction) y, and a third direction (a height direction) z. The body 2 has a first principal surface that is a mount surface 2*a* when mounting the inductor 1 on a substrate, a second principal surface 2*b* that faces the mount surface 2*a*, a first side surface 2*c* and a third side surface 2*e* that are adjacent to the first principal surface and the second principal surface and that extend in the width direction x, and a second side surface 2*d* and a fourth side surface 2*f* that are adjacent to the first principal surface and the second principal surface and that extend in the depth direction y. The dimensions of the body 2 are, for example, about 1.6 mm or greater and about 13 mm or less (i.e., from about 1.6 mm to about 13 mm) in length in the width direction x, about 0.8 mm or greater and about 13 mm or less (i.e., from about 0.8 mm to about 13 mm) in length in the depth direction, and about 0.5 mm or greater and about 13 mm or less (i.e., from about 0.5 mm to about 13 mm) in length in the height direction z.

Coil

The coil 8 includes the winding portion 10 that is formed by winding conductors and the pair of extended portions 12 extended from the winding portion 10. The winding portion 10 includes a first meandering portion 20 and a second meandering portion 30 that each include a plurality of straight portions that are continuously formed. In the first meandering portion 20 and the second meandering portion 30, when the straight portions are seen through the second principal surface 2*b* of the body 2 from the second principal surface 2*b* of the body 2, the straight portions are continuously formed clockwise from an outer side to an inner side of the body 2. The first meandering portion 20 and the second meandering portion 30 are continuously formed on the inner side of the body 2, and the straight portions of the first meandering portion 20 and the straight portions of the second meandering portions 30 are disposed apart from each other.

As the conductors out of which the coil 8 is formed, for example, a conductive wire in which the conductors are provided with covering layers, or a linear metal plate is used.

When a conductive wire is used as the conductors out of which the coil 8 is formed, each conductor of the conductive wire is made of, for example, copper, and is, for example, about 200 μm or greater and about 500 μm or less (i.e., from about 200 μm to about 500 μm) in width and about 100 μm or greater and about 700 μm or less (i.e., from about 100 μm to about 700 μm) in thickness. Each covering layer is made of an insulating resin, such as polyamide imide, and is, for example, about 2 μm or greater and about 10 μm or less (i.e., from about 2 μm to about 10 μm) in thickness and, desirably, about 6 μm in thickness.

When a linear metal plate is used as the conductors out of which the coil 8 is formed, the metal plate is made of, for example, copper, and is, for example, about 200 μm or greater and about 500 μm or less (i.e., from about 200 μm to about 500 μm) in width and about 100 μm or greater and about 700 μm or less (i.e., from about 100 μm to about 700 μm) in thickness. The metal plate may be formed so that its surface includes a first nickel (Ni) plating layer and a second tin (Sn) plating layer that is provided on the first nickel (Ni) plating layer.

Winding Portion

The winding portion 10 includes the first meandering portion 20 and the second meandering portion 30 that each include the plurality of straight portions that are continuously formed.

The plurality of straight portions extend in the width direction x or the depth direction y of the body 2. The conductors out of which the winding portion 10 is formed do not have regions that overlap each other in the height direction z of the body 2. That is, the winding portion 10 is formed by winding the conductors in a plane that is substantially parallel to the mount surface 2*a* of the body 2.

When the first meandering portion 20 is seen through the second principal surface 2*b* of the body 2 from the second principal surface 2*b* of the body 2, the first meandering portion 20 is formed so that the conductor is successively folded from the outer side to the inner side of the body 2. When the conductor is seen through the second principal surface 2*b* of the body 2 from the second principal surface 2*b* of the body 2, the conductor is spirally wound clockwise from the outer side to the inner side of the body 2. The portions of the conductor extending between folding locations are disposed in straight lines and constitute the straight portions.

The second meandering portion 30 is connected to the first meandering portion 20 on the inner side of the body 2. When the second meandering portion 30 is seen through the second principal surface 2*b* of the body 2 from the second principal surface 2*b* of the body 2, the second meandering portion 30 is formed so that the conductor is successively folded from the inner side to the outer side of the body 2. When the conductor is seen through the second principal surface 2*b* of the body 2 from the second principal surface 2*b* of the body 2, the conductor is spirally wound counterclockwise from the inner side to the outer side of the body 2. It can also be said that when the conductor is seen from the outer side of the body 2 and is seen through the second principal surface 2*b* of the body 2 from the second principal surface 2*b* of the body 2, the conductor is spirally wound clockwise from the outer side to the inner side of the body 2. The portions of the conductor extending between folding locations are disposed in straight lines and constitute the straight portions. The straight portions of the second meandering portion 30 are disposed apart from the straight portions of the first meandering portion 20.

Therefore, when the winding portion 10 is seen through the second principal surface 2*b* of the body 2 from the second principal surface 2*b* of the body 2, the winding portion 10 is formed by successively folding the conductor clockwise from the outer side to the inner side of the body 2, reversing the direction on the inner side of the body 2, and successively folding the conductor counterclockwise from the inner side to the outer side of the body 2.

The winding portion 10 including the first meandering portion 20 and the second meandering portion 30 formed in this way is disposed in a plane substantially parallel to the mount surface 2*a* of the body 2.

The first meandering portion 20 and the second meandering portion 30 are described in detail below.

The first meandering portion 20 of the winding portion 10 includes a first straight portion 21 to a fifth straight portion 25. The first straight portion 21 extends in the width direction x of the body 2. The first straight portion 21 is a straight portion that is disposed on an outermost side of the winding portion 10 and that is disposed closest to the third side surface 2*e* of the body 2. The second straight portion 22 is connected to the first straight portion 21 and extends in the depth direction y. The second straight portion 22 is a straight portion that is disposed on an outermost side of the winding portion 10 and that is disposed closest to the fourth side surface 2*f* of the body 2. The third straight portion 23 is connected to the second straight portion 22 and extends in the width direction x of the body 2. The third straight portion 23 is disposed on an inner side with respect to a first straight portion 31 of the second meandering portion 30 described below. The fourth straight portion 24 is connected to the third straight portion 23 and extends in the depth direction y of the body 2. The fourth straight portion 24 is disposed on an inner side with respect to a second straight portion 32 of the second meandering portion 30 described below. The fifth straight portion 25 is connected to the fourth straight portion 24 and extends in the width direction x of the body 2. The fifth straight portion 25 is disposed on an inner side with respect to the third straight portion 23 and a third straight portion 33 of the second meandering portion 30 described below. Further, the fifth straight portion 25 is disposed between the first side surface 2*c* and the third side surface 2*e* of the body 2, and, when the fifth straight portion 25 is seen through the second principal surface 2*b* of the body 2 from the second principal surface 2*b* of the body 2, the fifth straight portion 25 is disposed so that a center point O2 coincides with a center point O1 of the body 2.

The second meandering portion 30 of the winding portion 10 includes the first straight portion 31 to a fourth straight portion 34. The first straight portion 31 extends in the width direction x of the body 2. The first straight portion 31 is a straight portion that is disposed on an outermost side of the winding portion 10 and that is disposed closest to the first side surface 2*c* of the body 2. The first straight portion 31 of the second meandering portion 30 has the same length as the length of the first straight portion 21 of the first meandering portion 20. The second straight portion 32 is connected to the first straight portion 31 and extends in the depth direction y of the body 2. The second straight portion 32 is a straight portion that is disposed on an outermost side of the winding portion 10 and that is disposed closest to the second side surface 2*d* of the body 2. The second straight portion 32 of the second meandering portion 30 has the same length as the length of the second straight portion 22 of the first meandering portion 20. The third straight portion 33 is connected to the second straight portion 32 and extends in the width direction x of the body 2. The third straight portion 33 is disposed between the first straight portion 21 of the first meandering portion 20 and the fifth straight portion 25 of the first meandering portion 20. The third straight portion 33 of the second meandering portion 30 has the same length as the length of the third straight portion 23 of the first meandering portion 20. The fourth straight portion 34 is connected to the third straight portion 33 and extends in the depth direction y of the body 2. The fourth straight portion 34 is disposed on an inner side with respect to the second straight portion 22 of the first meandering portion 20. The fourth straight portion 34 is connected to the fifth straight portion 25 of the first meandering portion 20. The fourth straight portion 34 of the second meandering portion 30 has the same length as the length of the fourth straight portion 24 of the first meandering portion 20.

Figure 2:
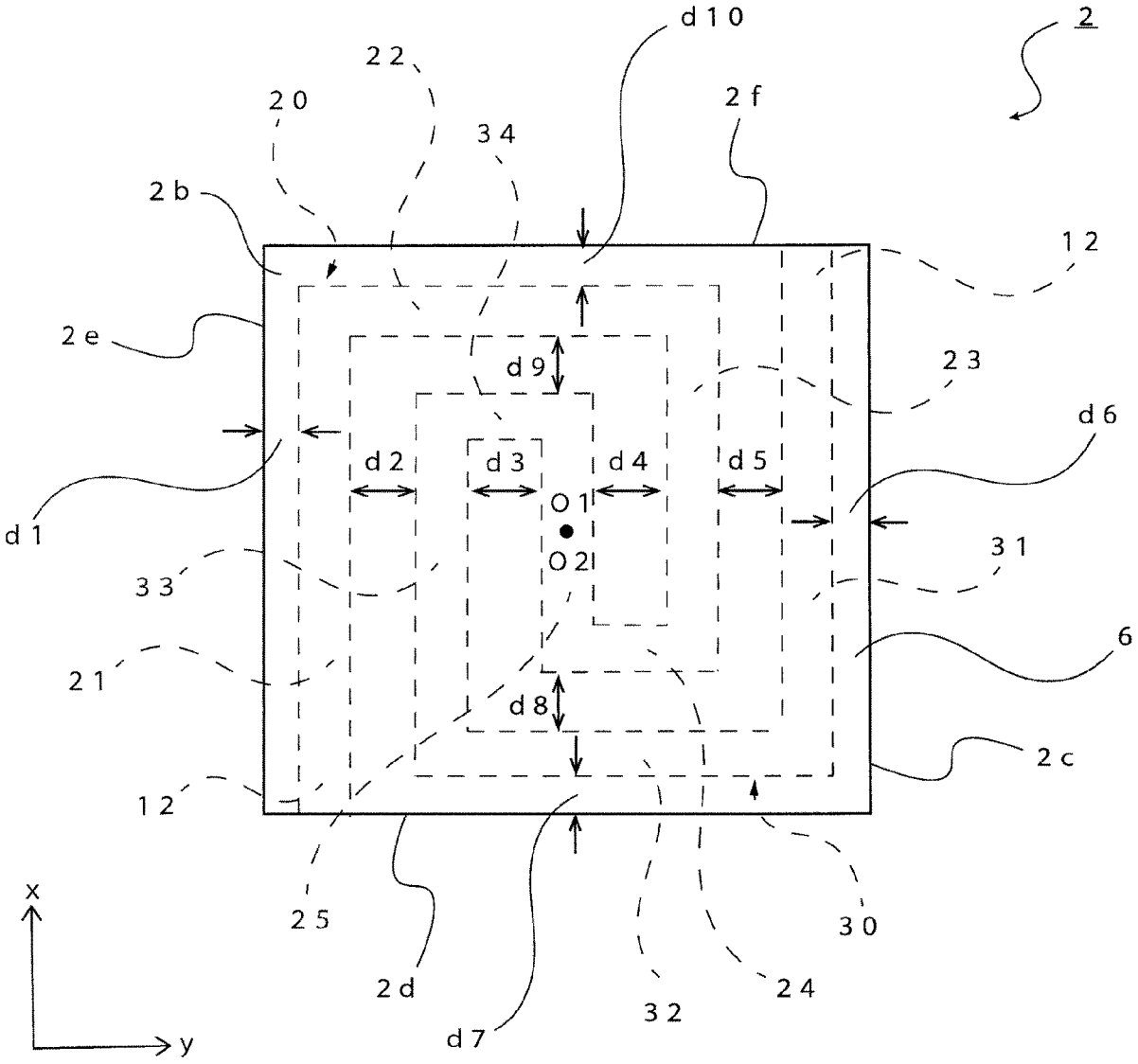
FIG. 2 is a top view of a body shown in FIG. 1.

Referring to FIG. 2, the arrangement of such straight portions 21 to 25 of the first meandering portion 20 and such straight portions 31 to 34 of the second meandering portion 30 is described in more detail below.

First, the straight portions 21, 23, 25, 31, and 33 extending in the width direction x of the body 2 are focused upon. The straight portions 21, 23, 25, 31, and 33 extending in the width direction x of the body 2 are disposed so that the first straight portion 21 of the first meandering portion 20, the third straight portion 33 of the second meandering portion 30, the fifth straight portion 25 of the first meandering portion 20, the third straight portion 23 of the first meandering portion 20, and the first straight portion 31 of the second meandering portion 30 are disposed in this order from the third side surface 2*e* of the body 2.

A first distance d1 between the third side surface 2*e* of the body 2 and the first straight portion 21 of the first meandering portion 20 and a sixth distance d6 between the first straight portion 31 of the second meandering portion 30 and the first side surface 2*c* of the body 2 are the same, and are a distance (a second interval) sw.

A second distance d2 between the first straight portion 21 of the first meandering portion 20 and the third straight portion 33 of the second meandering portion 30, a third distance d3 between the third straight portion 33 of the second meandering portion 30 and the fifth straight portion 25 of the first meandering portion 20, a distance d4 between the fifth straight portion 25 of the first meandering portion 20 and the third straight portion 23 of the first meandering portion 20, and a distance d5 between the third straight portion 23 of the first meandering portion 20 and the first straight portion 31 of the second meandering portion 30 are all the same, and are a distance (a first interval) gap. The second distance d2 to the fifth distance d5 are represented as distances between straight portions that are adjacent to each other and that face each other among the straight portions 21, 23, 25, 31, and 33 extending in the width direction x of the body 2.

The first interval gap and the second interval sw have the relationship of $gap/4 \leq sw \leq gap$, desirably, the relationship of $gap/4 < sw < gap$, and, more desirably, the relationship of $sw \approx gap/2$.

Next, the straight portions 22, 24, 32, and 34 extending in the depth direction y of the body 2 are focused upon. The straight portions 22, 24, 32, and 34 extending in the depth direction y of the body 2 are disposed so that the second straight portion 32 of the second meandering portion 30, the fourth straight portion 24 of the first meandering portion 20, the fourth straight portion 34 of the second meandering portion 30, and the second straight portion 22 of the first meandering portion 20 are disposed in this order from the second side surface 2*d* of the body 2.

A seventh distance d7 between the second side surface 2*d* of the body 2 and the second straight portion 32 of the second meandering portion 30 and a tenth distance d10 between the second straight portion 22 of the first meandering portion 20 and the fourth side surface 2*f* of the body 2 are the same and are a distance (a fourth interval) sw'.

An eighth distance d8 between the second straight portion 32 of the second meandering portion 30 and the fourth straight portion 24 of the first meandering portion 20 and a ninth distance d9 between the fourth straight portion 34 of the second meandering portion 30 and the second straight portion 22 of the first meandering portion 20 are a distance (a third interval) gap'. The eighth distance d8 and the ninth distance d9 are represented as distances between straight portions that are adjacent to each other and that face each other among the straight portions 22, 24, 32, and 34 extending in the depth direction y of the body 2.

The third interval gap' and the fourth interval sw' have the relationship of $gap'/4 \leq sw' \leq gap'$, desirably, the relationship of $gap'/4 < sw' < gap'$, and, more desirably, the relationship of $sw' \approx gap'/2$.

Further, it is desirable that the third interval gap' be equal to the first interval gap, and the fourth interval sw' be equal to the second interval sw.

Therefore, when the straight portions are seen through the second principal surface 2*b* of the body 2 from the second principal surface 2*b* of the body 2, the straight portions are disposed so that the straight portions are point-symmetrically disposed with respect to the center point O1 of the body 2, and the external shape of the winding portion 10 in plan view is a substantially rectangular shape.

Extended Portions

One extended portion 12 of the pair of extended portions 12 is connected to the first straight portion 21 of the first meandering portion 20. The other extended portion 12 is connected to the first straight portion 31 of the second meandering portion 30. One section of each extended portion 12 of the pair of extended portions 12 is exposed from the second side surface 2*d* or the fourth side surface 2*f* of the body 2.

Magnetic Portion

The magnetic portion 6 covers the coil 8 excluding the one section of each extended portion 12 of the pair of extended portions 12.

The magnetic portion 6 is formed by subjecting a mixture of magnetic powder and a resin to compression molding. A filling rate of the magnetic powder in the mixture is, for example, about 60 wt % or greater and desirably about 80 wt % or greater. As the magnetic powder, ferrous metal magnetic powder, such as Fe, Fe—Si—Cr, Fe—Ni—Al, Fe—Cr—Al, Fe—Si, Fe—Si—Al, Fe—Ni, or Fe—Ni—Mo, or metal magnetic powder of other compositions, amorphous metal magnetic powder or the like, metal magnetic powder whose surface is covered by an insulator, such as glass, metal magnetic powder whose surface has been reformed, or nano-level fine metal magnetic powder is used. As the resin, a thermosetting resin, such as an epoxy resin, a polyimide resin, or a phenol resin, or a thermoplastic resin, such as a polyethylene resin or a polyamide resin is used.

External Electrodes

The pair of external electrodes 4 are formed on the surfaces of the body 2 and are disposed apart from each other. One of the external electrodes 4 is disposed on the second side surface 2*d* and on a portion of each of the mount surface 2*a*, the second principal surface 2*b*, the first side surface 2*c*, and the third side surface 2*e* of the body 2. The one of the external electrodes 4 covers the section of one of the extended portions 12 exposed from the body 2 and is electrically connected to the coil 8 through this section. The other external electrode 4 is disposed on the fourth side surface 2*f* and a portion of each of the mount surface 2*a*, the second principal surface 2*b*, the first side surface 2*c*, and the third side surface 2*e* of the body 2. The other external electrode 4 covers the section of the other extended portion 12 exposed from the body 2 and is electrically connected to the coil 8 through this section.

The pair of external electrodes 4 are made of, for example, a conductive resin including metal particles and a resin. For the metal particles, silver is used. For the resin, an epoxy resin is used. The pair of external electrodes 4 are formed by forming a first layer on the conductive resin, which includes the metal particles and the resin, and by forming tin on the first layer, the first layer being made of nickel.

In the inductor having such a structure, the straight portions are point-symmetrically disposed with respect to the center point O1 of the body 2, and are disposed so as to satisfy $gap/4 \leq sw \leq gap$ ($gap'/4 \leq sw' \leq gap'$). Therefore, a distribution of a magnetic density in the inductor becomes uniform and thus an energy distribution in the inductor also becomes uniform. Thus, it is possible to acquire an inductor in which magnetic saturation is suppressed and a rated current that is determined by a reduction in an inductance value is increased.

Further, although, in general, in order to increase the inductance value, the thickness of the conductor is sometimes reduced, when the thickness of the conductor is reduced, the direct-current resistance is increased. However, in the inductor having the structure described above, since it is possible to sufficiently ensure the length of the conductor by disposing the conductor in a meandering manner, it is possible to acquire a sufficient inductance value without reducing the thickness of the conductor. Therefore, in the inductor having the structure described above, it is possible to increase the inductance value and at the same time suppress an increase in the direct-current resistance.

In the inductor having the structure described above, the first meandering portion 20 and the second meandering portion 30 do not overlap each other in plan view. That is, the conductors do not overlap each other in the height direction z. Therefore, in a compressing step, described below, performed when forming the body 2, it is possible to prevent a short circuit caused by the conductors being in contact with each other from occurring.

The inductor having such a structure includes the body 2 including the coil 8 and the magnetic portion 6, and has the two principal surfaces that face each other and the side surfaces that are adjacent to the two principal surfaces. The coil 8 includes the winding portion 10 that is formed from conductors and the pair of extended portions 12 extended from the winding portion 10. The magnetic portion 6 includes magnetic powder and contains the coil 8 therein. The winding portion 10 includes the first meandering portion 20 and the second meandering portion that each include the plurality of straight portions that are continuously formed so as to extend substantially circularly from the outer side to the inner side of the body 2 when the winding portion 10 is seen through the principal surfaces of the body from the principal surfaces of the body, the first meandering portion 20 and the second meandering portion 30 are continuously formed on the inner side of the body 2, and the straight portions that constitute the first meandering portion 20 and the straight portions that constitute the second meandering portions 30 are disposed apart from each other.

2. Second Embodiment

Figure 3:
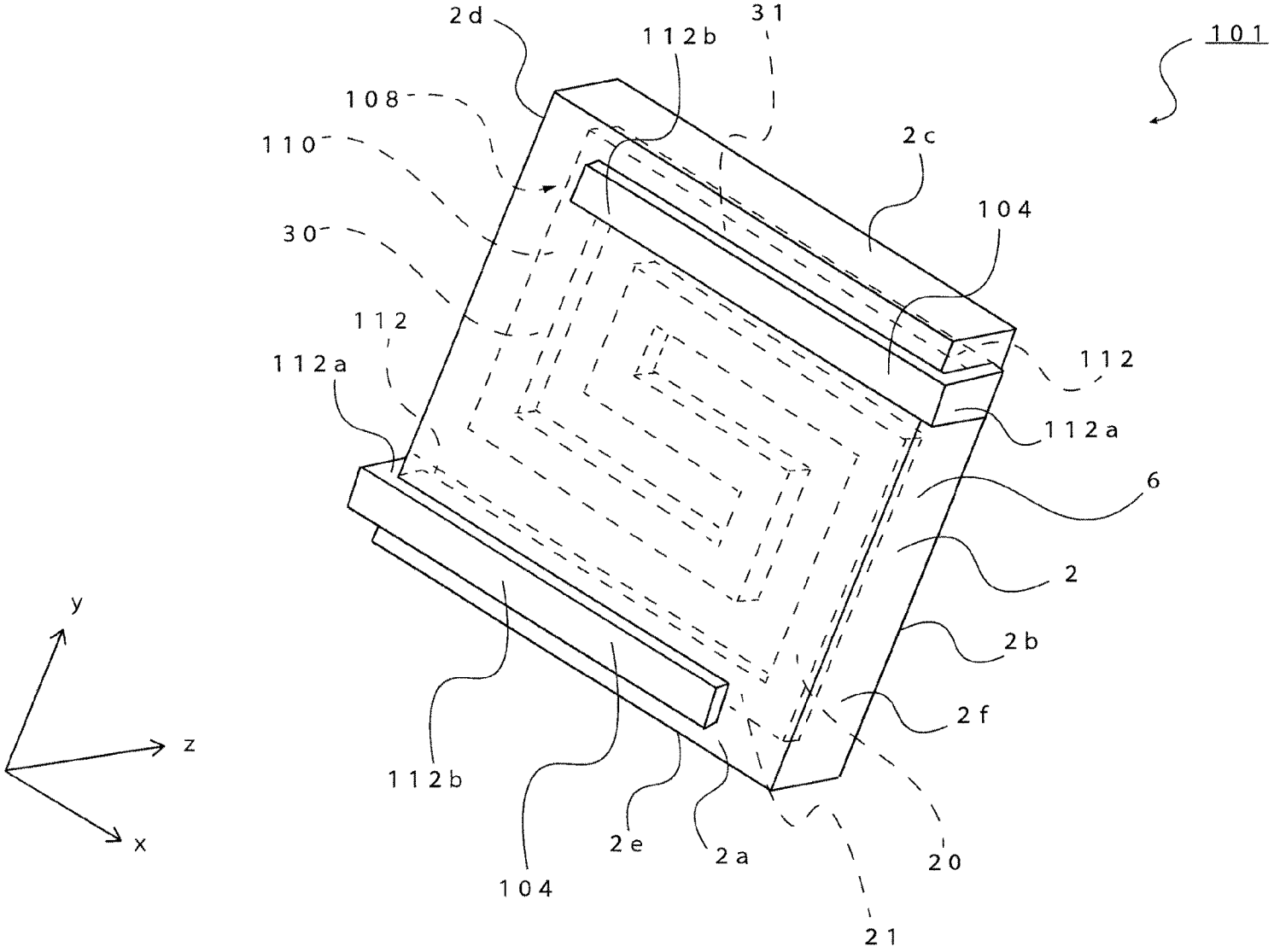
FIG. 3 is a bottom perspective of an inductor according to a second embodiment of the present disclosure.

Next, an inductor 101 according to a second embodiment is described with reference to FIG. 3. FIG. 3 is a bottom perspective of the inductor according to the second embodiment of the present disclosure.

The inductor 101 according to the present embodiment differs from the inductor 1 according to the first embodiment in the structure of external electrodes.

The inductor 101 according to the second embodiment includes a body 2 and a pair of external electrodes 104. The body 2 includes a coil 108 and a magnetic portion 6. The coil 108 includes a winding portion 110 and a pair of extended portions 112 extended from the winding portion 110. The coil 108 is buried in the magnetic portion 6.

The winding portion 110 includes a first meandering portion 20 that includes a first straight portion 21 to a fifth straight portion and a second meandering portion 30 that includes a first straight portion 31 to a third straight portion.

The pair of extended portions 112 are each connected to the first straight portion 21 of the first meandering portion 20 or the first straight portion 31 of the second meandering portion 30. End portions of each extended portion 112 further include a first region 112*a* and a second region 112*b* exposed from the body 2.

Each first region 112*a* is formed by causing the corresponding end portion of the extended portion 112 to be exposed from a second side surface 2*d* (or a fourth side surface 21) of the body 2 and disposing the corresponding end portion of the extended portion 112 on the second side surface 2*d* (or the fourth side surface 21) of the body 2, and extends in the height direction z.

Each second region 112*b* is formed by being connected to the first region 112*a* and by being disposed on a mount surface 2*a* of the body 2, and extends in the width direction x. The first regions 112*a* and the second regions 112*b* function as the external electrodes 104. At this time, when the coil is formed by using a conductive wire in which conductors are provided with covering layers, the first regions 112*a* and the second regions 112*b* are formed by removing the covering layers and causing the conductors to be exposed.

In the inductor 101 having such a structure, a portion of each extended portion 112 can be used as the external electrode 104, and thus the number of components can be reduced. Therefore, it is possible to simplify the manufacturing process and to reduce manufacturing costs. Unlike the first embodiment, since contact resistance does not exist between the external electrodes and the extended portions, it is possible to reduce a direct-current resistance Rdc of the inductor.

3. Third Embodiment

Figure 4:
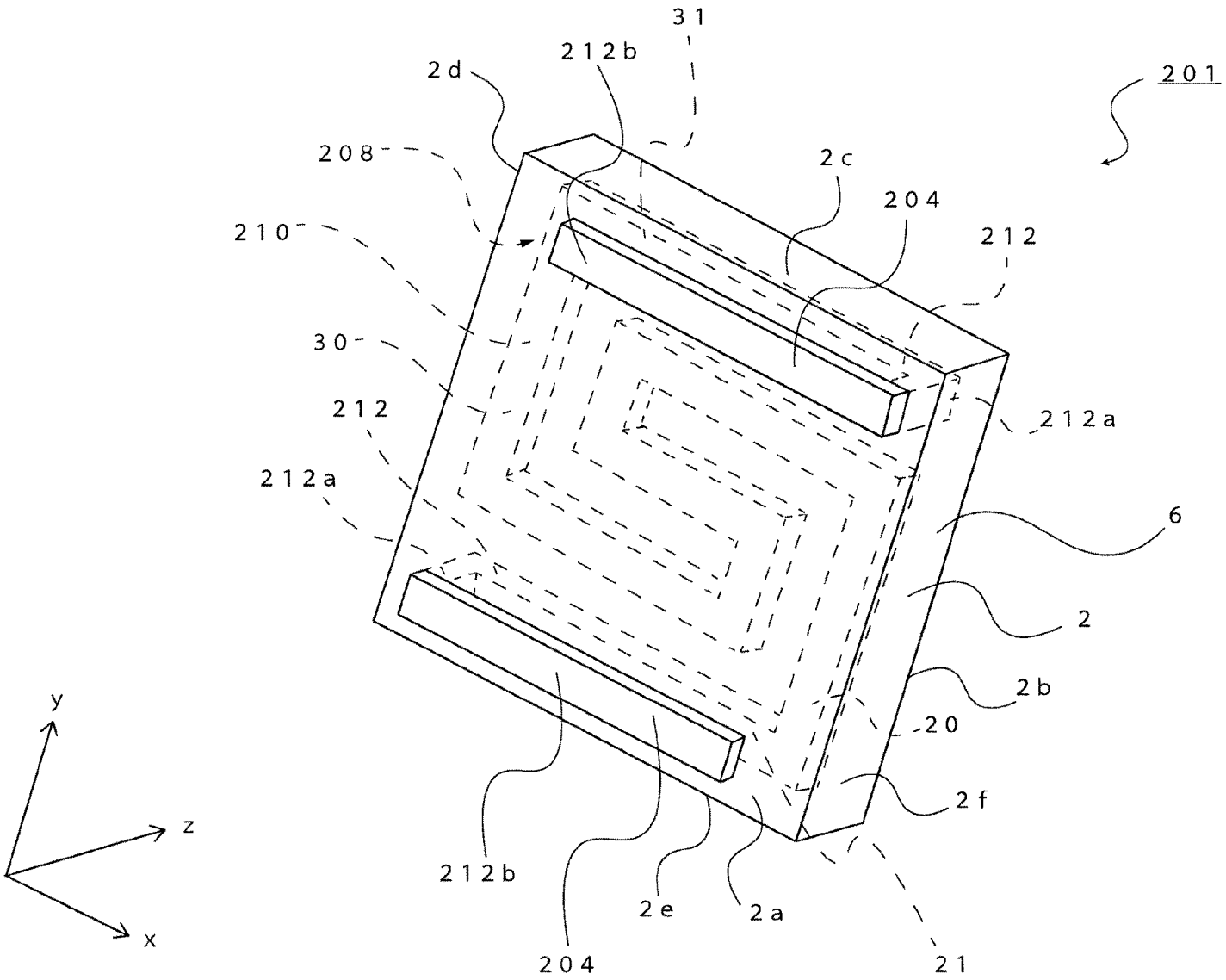
FIG. 4 is a bottom perspective view of an inductor according to a third embodiment of the present disclosure.

Next, an inductor 201 according to a third embodiment is described with reference to FIG. 4. FIG. 4 is a bottom perspective view of the inductor according to the third embodiment of the present disclosure.

The inductor 201 according to the present embodiment is similar to the inductor 101 of the second embodiment, and differs from the inductor 101 of the second embodiment in the structure of extended portions and external electrodes.

The inductor 201 according to the third embodiment includes a body 2 and a pair of external electrodes 204. The body 2 includes a coil 208 and a magnetic portion 6. The coil 208 includes a winding portion 210 and a pair of extended portions 212 extended from the winding portion 210. The coil 208 is buried in the magnetic portion 6.

The winding portion 110 includes a first meandering portion 20 that includes a first straight portion 21 to a fifth straight portion and a second meandering portion 30 that includes a first straight portion 31 to a third straight portion.

The pair of extended portions 212 are each connected to the first straight portion 21 of the first meandering portion 20 or the first straight portion 31 of the second meandering portion 30. Each extended portion 212 extends up to a mount surface 2*a* in the height direction z inside the body 2, and an end portion of each extended portion 212 further includes a first region 212*a* exposed from the mount surface 2*a* of the body 2.

Each second region 212*b* is disposed on the mount surface 2*a* of the body 2 and extends in the width direction x.

In the inductor 201 having such a structure, a portion of each extended portion 212 can be used as the external electrode 204, and thus the number of components can be reduced. Therefore, it is possible to simplify the manufacturing process and to reduce manufacturing costs. Unlike the first embodiment, since contact resistance does not exist between the external electrodes and the extended portions, it is possible to reduce a direct-current resistance Rdc of the inductor. Further, since the external electrodes are disposed only on the mount surface of the body, it is possible to reduce the mount area of the inductor 201.

4. Fourth Embodiment

Figure 5:
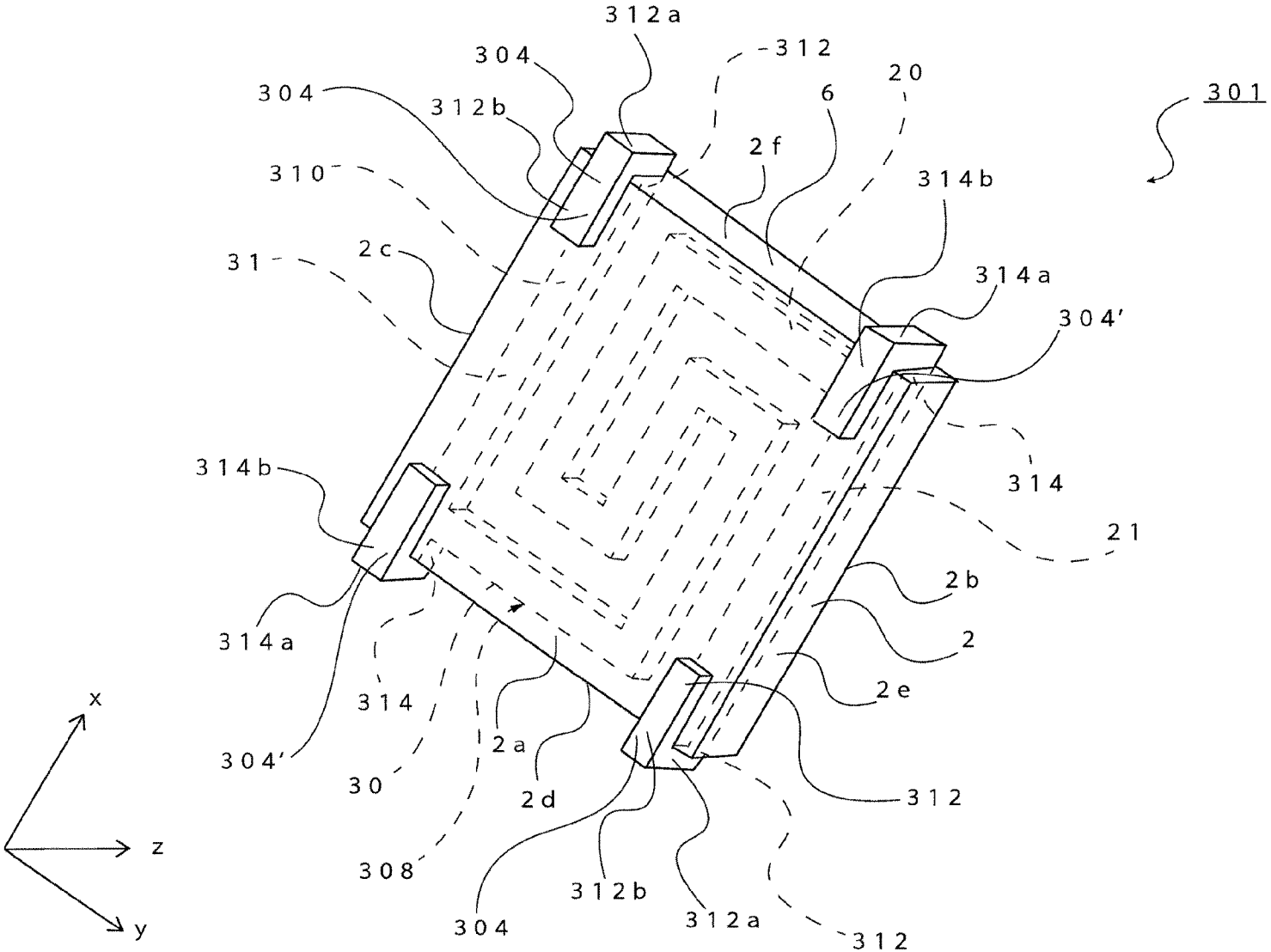
FIG. 5 is a bottom perspective view of an inductor according to a fourth embodiment of the present disclosure.

Next, an inductor 301 according to a fourth embodiment is described with reference to FIG. 5. FIG. 5 is a bottom perspective view of the inductor according to the fourth embodiment of the present disclosure.

The inductor 301 according to the fourth embodiment includes a body 2 and a pair of external electrodes 304. The body 2 includes a coil 308 and a magnetic portion 6. The coil 308 includes a winding portion 310 and a pair of extended portions 312 extended from the winding portion 310. The coil 308 is buried in the magnetic portion 6.

The winding portion 310 includes a first meandering portion 20 that includes a first straight portion 21 to a fifth straight portion and a second meandering portion 30 that includes a first straight portion 31 to a third straight portion.

The pair of extended portions 312 are each connected to the first straight portion 21 of the first meandering portion 20 or the first straight portion 31 of the second meandering portion 30. End portions of each extended portion 312 further include a first region 312*a* and a second region 312*b* exposed from the body 2.

Each first region 312*a* is formed by causing the corresponding end portion of the extended portion 312 to be exposed from a second side surface 2*d* (or a fourth side surface 21) of the body 2 and by disposing the corresponding end portion of the extended portion 312 on the second side surface 2*d* (or the fourth side surface 2*f*) of the body 2, and extends in the height direction z.

Each second region 312*b* is formed by being connected to the first region 312*a* and by being disposed on the mount surface 2*a* of the body 2, and extends in the width direction x. The first regions 312*a* and the second regions 312*b* function as the external electrodes 304.

In the inductor 301 according to the present embodiment, the coil 308 further includes a pair of pseudo extended portions 314. At a corresponding one of the first straight portion 21 of the first meandering portion 20 and the first straight portion 31 of the second meandering portion 30, each of the two pseudo extended portions 314 is disposed at an end portion on a side opposite to the end portion at which the extended portion 312 is disposed. The pseudo extended portions 314 are each connected to the first straight portion 21 of the first meandering portion 20 or the first straight portion 31 of the second meandering portion 30. End portions of each pseudo extended portion 314 further include a first region 314*a* and a second region 314*b* exposed from the body 2.

Each first region 314*a* is formed by causing an end portion of the pseudo extended portion 314 to be exposed from the fourth side surface 2*f* (or the second side surface 2*d*) of the body 2 and by disposing the end portion of the pseudo extended portion 314 on the fourth side surface 2*f* (or the second side surface 2*d*) of the body 2, and extends in the height direction z.

Each second region 314*b* is formed by being connected to the first region 312*a* and by being disposed on the mount surface 2*a* of the body 2, and extends in the width direction x. The first regions 312*a* and the second regions 312*b* function as pseudo external electrodes 304'.

Since the inductor 301 having such a structure is connected to a circuit board in a balanced manner by four external electrodes, it is possible to increase the joining strength between the inductor and the circuit board. If, in the inductor 301 having such a structure, the pseudo external electrodes are used as middle taps, it is possible to adjust the inductance without changing the structure.

5. Modifications

Figure 6B:
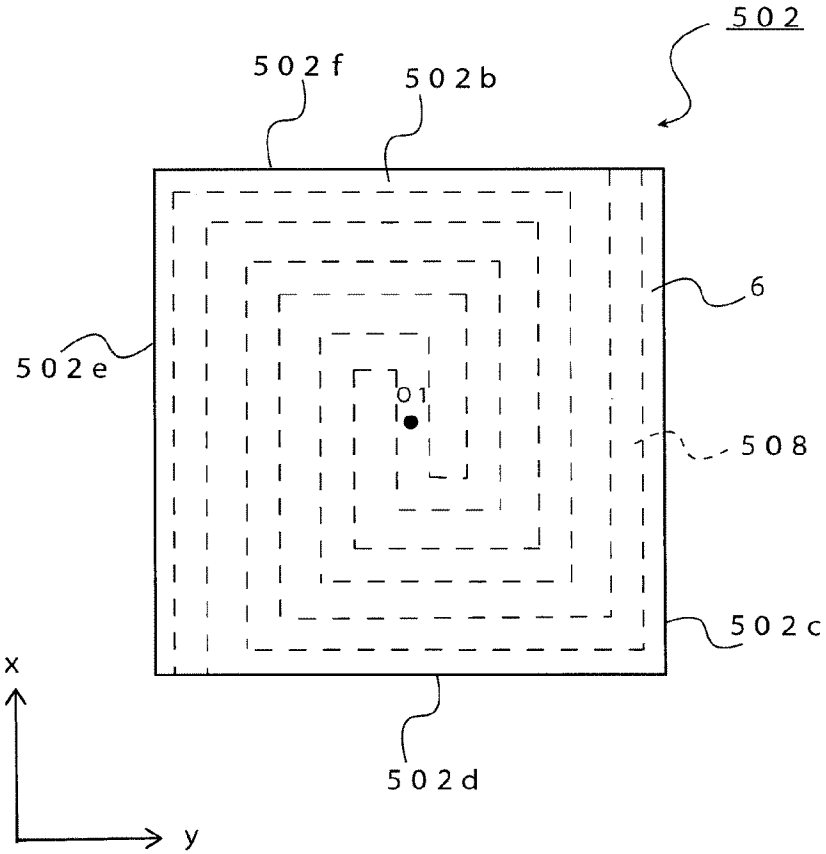
FIG. 6B is a top view of a body of an inductor according to Modification 2 of the present disclosure.
Figure 6A:
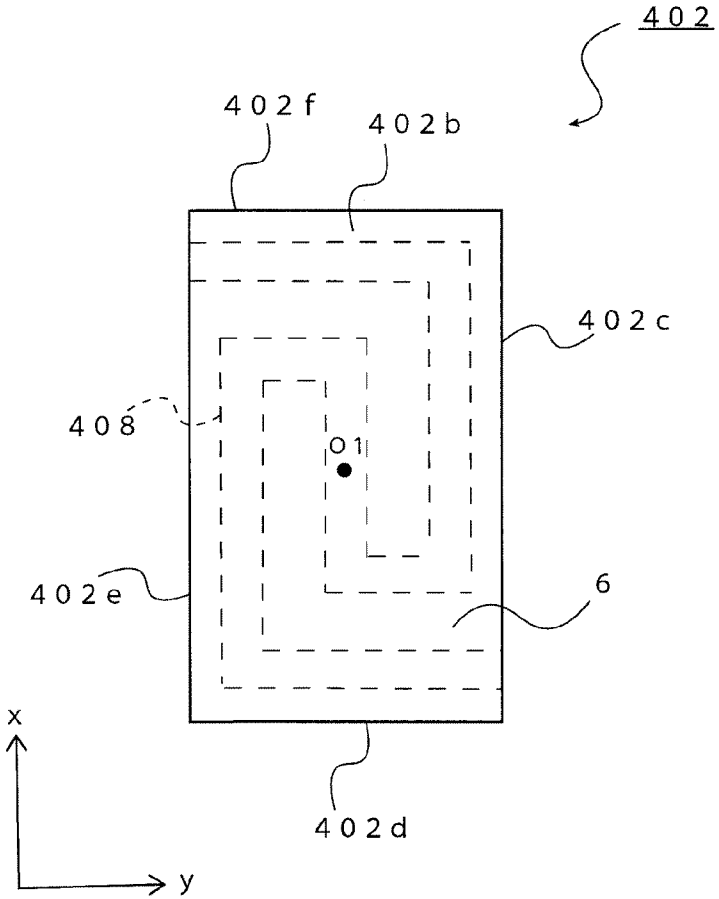
FIG. 6A is a top view of a body of an inductor according to Modification 1 of the present disclosure.

Next, modifications according to the present disclosure are described with reference to FIGS. 6A and 6B. FIG. 6A is a top view of a body of an inductor according to Modification 1 of the present disclosure. FIG. 6B is a top view of a body of an inductor according to Modification 2 of the present disclosure.

The winding portions 10, 110, 210, and 310 according to the first to the fourth embodiments above each include the first meandering portion 20 including the five straight portions 21 to 25 and the second meandering portion 30 including the four straight portions 31 to 34. However, the number of straight portions that the winding portion 10 includes is not limited thereto.

The winding portion includes the straight portions point-symmetrically disposed with respect to the center point O1. Therefore, the number of straight portions is to be 2n+1 (n≥3). In particular, when n is an odd number, that is, when the number of straight portions is 4i+3(i≥1), as shown in FIG. 6A, the external shape of a coil 408 in plan view is a substantially oblong shape. Therefore, the shape of a body 402 in plan view is also a substantially oblong shape. In particular, when n is an even number, that is, when the number of straight portions is 4j+1(j≥2), as shown in FIG. 6B, the external shape of a coil 508 in plan view is a substantially square shape. Therefore, the shape of a body 502 in plan view is also a substantially square shape.

Even in the inductors having such structures, a plurality of straight portions are point-symmetrically disposed and thus the inductors have a high Isat.

7. Manufacturing Method

Next, a method of manufacturing an inductor according to the present disclosure is described.

The method of manufacturing an inductor according to the present disclosure includes:

(1) a step of forming a coil, (2) a step of forming a body by burying the coil in a magnetic portion, and (3) a step of forming external electrodes.

(1) Step of Forming Coil

Examples of the step of forming a coil can include the following three methods.

The first method is a method that is performed when, as conductors out of which the coil is formed, a conductive wire in which the conductors are provided with covering layers is used. In the first method, the conductive wire is repeatedly bent to successively form one of the extended portions, a first meandering portion that is formed continuously with the one of the extended portions, a second meandering portion that is formed continuously with the first meandering portion, and the other extended portion that is formed continuously with the second meandering portion.

Figure 7:
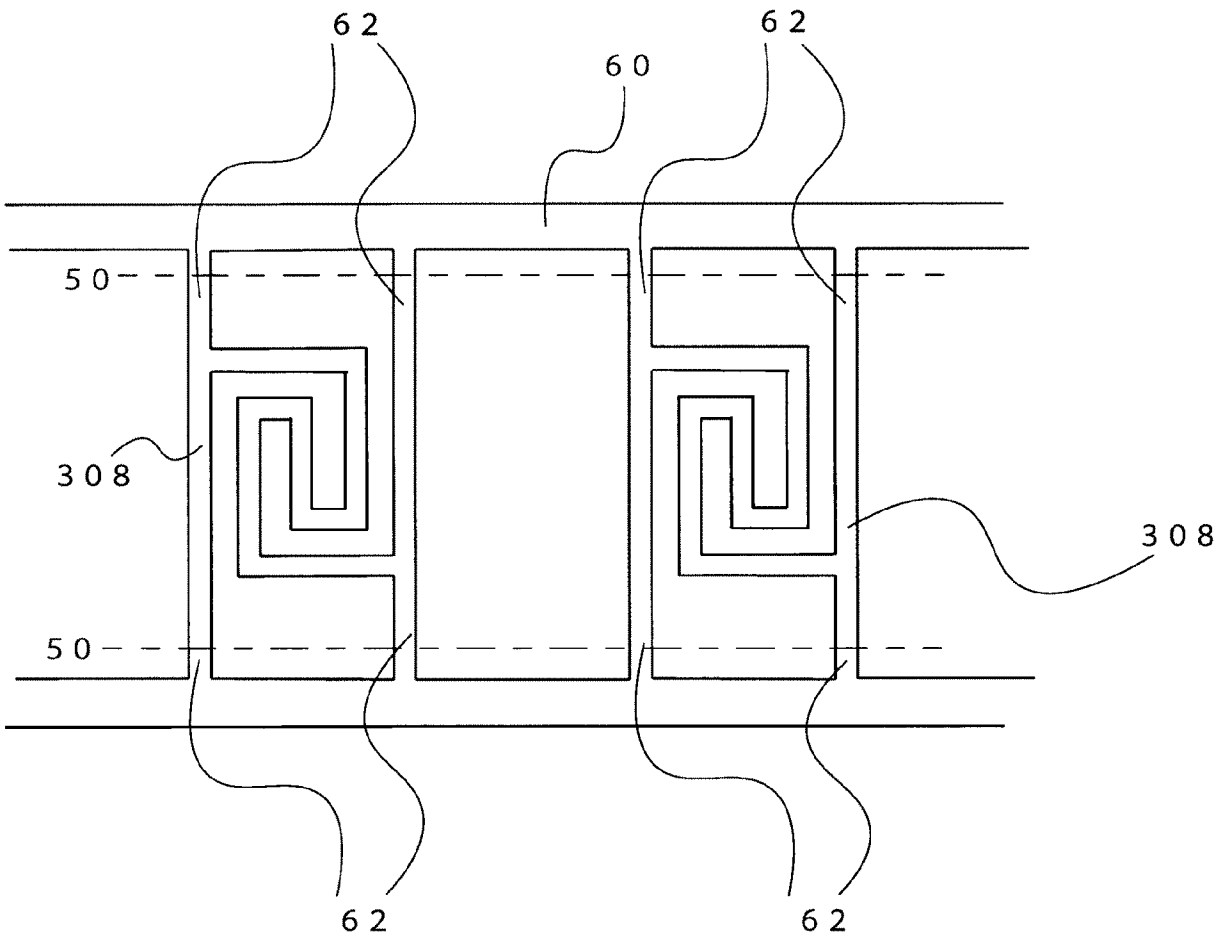
FIG. 7 shows a method of forming the coil according to the fourth embodiment of the present disclosure.

The second method is a method that is performed when, as conductors out of which coils 308 are formed, a linear metal plate is used. FIG. 7 shows a method of forming the coil according to the fourth embodiment of the present disclosure.

In this method, first, shapes of the plurality of coils 308 are cut in one metal plate 60. Each coil 308 whose shape has been cut is cut off from the metal plate 60 either before or after forming a body. At this time, when connecting portions 62 that connect the coils 308 and the metal plate 60 to each other are cut off along two alternate long and short dashed lines and when the connecting portions 62 that are formed continuously with the coils 308 are bent, it is possible to acquire the coils 308 according to the fourth embodiment. Note that the distance between the two alternate long and short dashed lines 50 is longer than the width of the body in the width direction (or the depth direction). This method makes it possible to form the extended portions 312 and the pseudo extended portions 314 according to the fourth embodiment at the same time.

In cutting the shapes of the plurality of coils 308 in one metal plate 60, when the number of connecting portions 62 that connect the corresponding coils is changed, it is possible to acquire the coil according to the first embodiment to the coil according to the third embodiment.

The third method is a method that is performed when a printed board having a winding pattern that forms the shape of a wiring portion is prepared and a conductive material out of which coils are formed is applied along the winding pattern.

In this method, first, the printed board having the wiring pattern of the wiring portion is prepared. As the material of the printed board, a material that is a mixture of magnetic powder and a resin is used. It is desirable that the dimensions of the printed board be substantially the same as the dimensions of a target inductor. Next, a coil material is applied on the wiring pattern and coils are stacked upon each other on the printed board. An example of the material out of which the coils are formed is a conductive resin including metal particles and a resin.

(2) Step of Forming Body

In this step, the coils and magnetic powder are disposed in a molding die and are compressed under a pressure of, for example, about 1 ton/$m^2$ to form the body. When the coils have been formed by using the printed board having the winding pattern, the coils are buried together with the printed board in a magnetic portion. As the magnetic powder material, for example, ferrous metal magnetic powder, such as Fe, Fe—Si—Cr, Fe—Ni—Al, Fe—Cr—Al, Fe—Si, Fe—Si—Al, Fe—Ni, or Fe—Ni—Mo, or metal magnetic powder of other compositions, amorphous metal magnetic powder or the like, metal magnetic powder whose surface is covered by an insulator, such as glass, metal magnetic powder whose surface has been reformed, or nano-level fine metal magnetic powder is used. As the resin, a thermosetting resin, such as an epoxy resin, a polyimide resin, or a phenol resin, or a thermoplastic resin, such as a polyethylene resin or a polyamide resin is used.

(3) Step of Forming External Electrodes

Examples of the step of forming external electrodes can include the following two methods.

The first method is a method that is performed when forming the external electrodes according to the first embodiment. In the first method, a pair of external electrodes that are disposed apart from each other are formed on the sections of the extended portions of the coils, the side surfaces of the body at which the sections of the extended portions are exposed, and portions of the four surfaces that are adjacent to the side surfaces. The pair of external electrodes are formed by applying a conductive resin having fluidity like a conductive paste onto the aforementioned positions of the body as a result of dipping, and by curing the conductive resin. The pair of external electrodes may be formed by plating the conductive resin. The plating includes a nickel layer that is formed on the conductive resin and a tin layer that is formed on the nickel layer.

The second method is a method that is performed when forming the external electrodes according to the second embodiment to the fourth embodiment. In the second method, the external electrodes are formed by bending the extended portions.

8. Examples

Figure 8B:
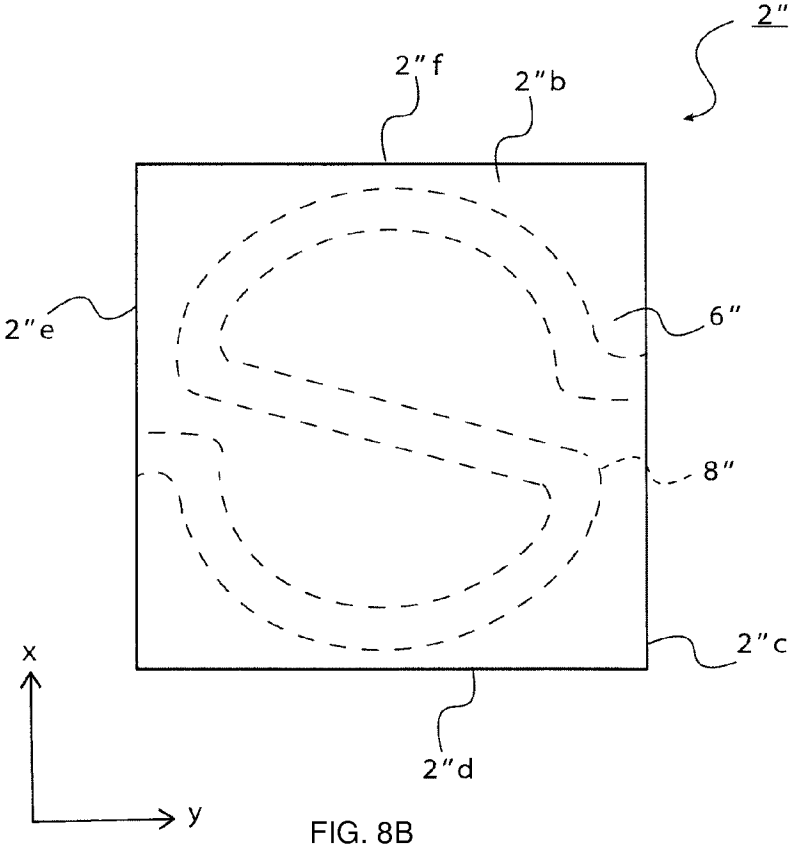
FIG. 8B is a top view of a body of an existing inductor including an S-shaped coil.
Figure 8A:
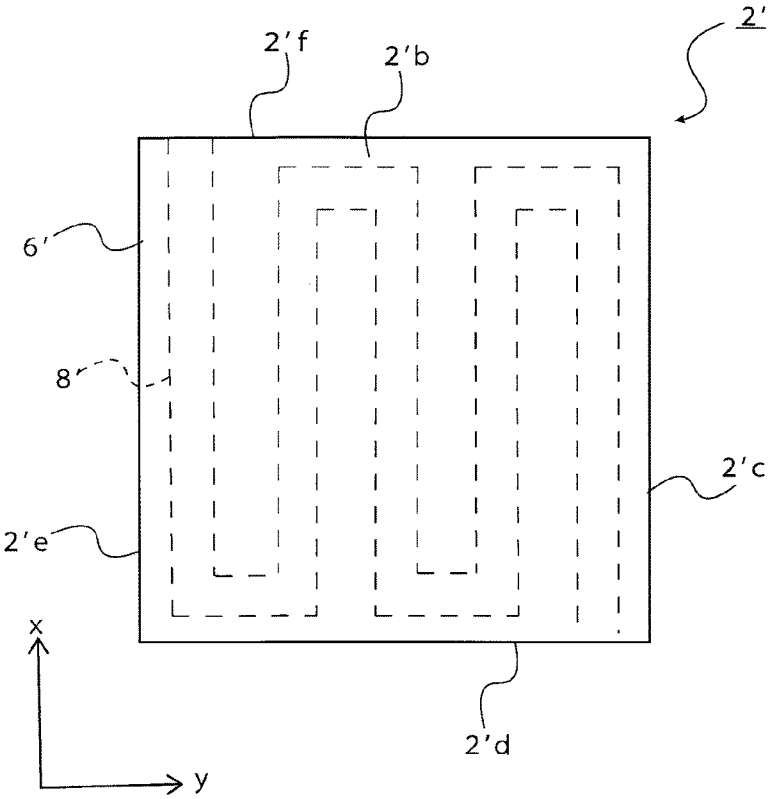
FIG. 8A is a top view of a body of an existing inductor including a meandering coil.

Examples are described with reference to FIGS. 8A and 8B. FIG. 8A is a top view of a body of an existing inductor including a meandering coil. FIG. 8B is a top view of a body of an existing inductor including an S-shaped coil.

For the inductor according to the first embodiment (Example 1), the inductor including the meandering coil (Comparative Example 1), and the inductor including the S-shaped coil (Comparative Example 2), when the inductance values were 37 nH, 54 nH, 73 nH, 85 nH, and 100 nH, direct-current resistances Rdc and rated currents Isat that were determined by a reduction in the inductance values by 30% with respect to initial values as a result of magnetic saturation were measured. The results are shown in Table 1 below. Table 1 also indicates the first interval gap, the second interval sw, the third interval gap', and the fourth interval sw' in the inductor of Example 1 that were set for each inductance value. Note that the dimensions of the body of each inductor were 4.0 mm in the width direction, 4.0 mm in the depth direction, and 1.0 mm in the height direction.

TABLE 1

| L (nH) | | 37 | 54 | 73 | 85 | 100 |
|---|---|---|---|---|---|---|
| EXAMPLE 1 | Rdc (mΩ) | 1.14 | 1.70 | 2.55 | 3.39 | 5.09 |
| | Isat (A) | 30.30 | 28.70 | 24.60 | 22.00 | 19.30 |
| | sw, sw' (mm) | 0.200 | 0.235 | 0.235 | 0.235 | 0.235 |
| | gap, gap' (mm) | 0.400 | 0.470 | 0.470 | 0.470 | 0.470 |
| COMPARATIVE EXAMPLE 1 | Rdc (mΩ) | 1.13 | 1.68 | 2.59 | 3.55 | 5.48 |
| | Isat (A) | 30.30 | 26.90 | 22.00 | 19.50 | 17.10 |
| COMPARATIVE EXAMPLE 2 | Rdc (mΩ) | 0.83 | 1.40 | 2.69 | 4.73 | |
| | Isat (A) | 27.83 | 25.80 | 20.01 | 18.40 | |

The inductor of Example 1 has rated current values larger than those of the inductors of the comparative examples for all inductance values. Further, the inductor of Example 1 has direct-current resistance values lower than those of the inductors of the comparative examples for inductance values greater than or equal to 73 nH and has direct-current resistance values slightly larger than those of the inductors of the comparative examples for smaller inductance values. Therefore, it is proven that the inductor according to the first embodiment has a high rated current and suppresses an increase in direct-current resistance.

Although the embodiments and the modifications of the present disclosure have been described, changes may be made in the details of the structures in the disclosed content, and, for example, changes in the combinations and the order of the elements in the embodiments and the modifications can be made without departing from the scope and the concepts of the present disclosure. For example, when the first meandering portion is seen through the second principal surface of the body 2 from the second principal surface of the body 2, the first meandering portion may be spirally wound counterclockwise from an outer periphery to the inner side of the body, and, when the second meandering portion is seen through the second principal surface of the body 2 from the second principal surface of the body 2, the second meandering portion may be spirally wound clockwise from the inner side to the outer side of the body. The width of the conductor of each extended portion may be wider than the width of the conductor of the winding portion.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. An inductor comprising:

a body that includes a coil and a magnetic portion, and that has two principal surfaces that face each other and side surfaces that are adjacent to the two principal surfaces, the coil including a winding portion having a conductor and a pair of extended portions extended from the winding portion, the magnetic portion including magnetic powder and containing the coil therein, wherein the winding portion includes a first meandering portion and a second meandering portion that each include a plurality of straight portions that are continuously configured so as to extend substantially circularly from an outer side to an inner side of the body when the winding portion is viewed through the principal surfaces of the body from the principal surfaces of the body, the first meandering portion and the second meandering portion are continuously configured on the inner side of the body, the straight portions of the first meandering portion and the straight portions of the second meandering portion are disposed apart from each other, the side surfaces of the body include two side surfaces that extend in a first direction and that face each other and two side surfaces that extend in a second direction and that face each other, the winding portion is disposed in a plane that is substantially parallel to the principal surfaces of the body, the plurality of straight portions include at least two straight portions that extend in the first direction and at least two straight portions that extend in the second direction, a first interval gap between those of the straight portions that are adjacent to each other and face each other among the straight portions extending in the first direction, and a second interval sw between one of the straight portions that is closest to one of the side surfaces extending in the first direction among the straight portions extending in the first direction and the one of the side surfaces extending in the first direction, have a relationship of gap/4≤sw≤gap, and a third interval gap' between those of the straight portions that are adjacent to each other and face each other among the straight portions extending in the second direction, and a fourth interval sw' between one of the straight portions that is closest to one of the side surfaces extending in the second direction among the straight portions extending in the second direction and the one of the side surfaces extending in the second direction, have a relationship of gap'/4≤sw'≤gap'.

2. The inductor according to claim 1, wherein the first interval gap and the third interval gap' are equal to each other, and the second interval sw and the fourth interval sw' are equal to each other.

3. The inductor according to claim 1, wherein an external shape of the winding portion is substantially a rectangle when the winding portion is viewed through the principal surfaces of the body from the principal surfaces of the body.

4. The inductor according to claim 1, wherein the plurality of straight portions which constitutes the winding portion are 4i+3 (i≥1) straight portions, and an external shape of the winding portion is substantially an oblong when the winding portion is viewed through the principal surfaces of the body from the principal surfaces of the body.

5. The inductor according to claim 1, wherein the plurality of straight portions which constitutes the winding portion are 4j+1 (j≥2) straight portions, and an external shape of the winding portion is substantially a square when the winding portion is viewed through the principal surfaces of the body from the principal surfaces of the body.

6. The inductor according to claim 1, wherein a portion of each extended portion is disposed on a mount surface constituting one of the principal surfaces of the body.

7. The inductor according to claim 1, wherein the coil includes a pseudo extended portion.

8. The inductor according to claim 1, wherein the magnetic powder is metal magnetic powder.

9. The inductor according to claim 1, wherein the conductor is a metal plate.

10. The inductor according to claim 1, wherein the coil includes a conductive material applied to a substrate having a winding pattern.

11. The inductor according to claim 2, wherein an external shape of the winding portion is substantially a rectangle when the winding portion is viewed through the principal surfaces of the body from the principal surfaces of the body.

12. The inductor according to claim 2, wherein the plurality of straight portions which constitutes the winding portion are 4i+3 (i≥1) straight portions, and an external shape of the winding portion is substantially an oblong when the winding portion is viewed through the principal surfaces of the body from the principal surfaces of the body.

13. The inductor according to claim 2, wherein the plurality of straight portions which constitutes the winding portion are 4j+1 (j≥2) straight portions, and an external shape of the winding portion is substantially a square when the winding portion is viewed through the principal surfaces of the body from the principal surfaces of the body.

14. The inductor according to claim 2, wherein a portion of each extended portion is disposed on a mount surface constituting one of the principal surfaces of the body.

15. The inductor according to claim 2, wherein the coil includes a pseudo extended portion.

16. The inductor according to claim 2, wherein the magnetic powder is metal magnetic powder.

17. The inductor according to claim 2, wherein the conductor is a metal plate.

18. The inductor according to claim 2, wherein the coil includes a conductive material applied to a substrate having a winding pattern.

* * * * *